United States Patent [19]

Rochla et al.

[11] 3,977,152

[45] Aug. 31, 1976

[54] METHOD AND APPARATUS FOR AUTOMATICALLY PACKAGING FLEXIBLE FLAT GOODS

[75] Inventors: Kurt Rochla; Horst Schneider; August Schwarzkopf, all of Lengerich, Germany

[73] Assignee: Windmoller & Holscher, Westphalia, Germany

[22] Filed: Oct. 15, 1974

[21] Appl. No.: 515,070

[30] Foreign Application Priority Data

Oct. 19, 1973 Germany ..... 2352666

[52] U.S. Cl. ..... 53/21 FW; 53/29; 53/51; 53/120; 53/183

[51] Int. Cl.[2] ..... B65B 63/04

[58] Field of Search ..... 53/21 FW, 29, 51, 120, 53/183

[56] References Cited

UNITED STATES PATENTS

| | | | |
|---|---|---|---|
| 3,481,099 | 12/1969 | Clancy | 53/120 X |
| 3,766,701 | 10/1973 | Besserdich et al. | 53/120 X |
| 3,805,482 | 4/1974 | O'Shea et al. | 53/120 |

*Primary Examiner*—Travis S. McGehee
*Attorney, Agent, or Firm*—Fleit & Jacobson

[57] ABSTRACT

Foldable sheet articles are packaged by forming a stack of the articles, folding the stack about a center line by exerting pressure from above the stack onto the center line, suspending a doubled-over web of packaging film by its edges below the stack, introducing the stack, fold line foremost, between the web edges from above in a direction at right-angles thereto and fully inserting it in the doubled web while supporting the lowermost web portion, welding the web shut by a seam at the edges and a separating weld seam perpendicular thereto while exerting pressure on the stack to expel air, and, simultaneously with the welding step, advancing the web so as to bring a succeeding length of web below a successive stack of sheet articles to be packaged.

29 Claims, 4 Drawing Figures

1
2
3
4
5
6
7
8
9
10
11
12
13
14
15
16
17
18
19
20
22
23
24
25
26
27
28
29
31
31.1
32
33
34
44
48
50
58
61
62
63
64
66
II
III

METHOD AND APPARATUS FOR AUTOMATICALLY PACKAGING FLEXIBLE FLAT GOODS

The invention relates to a method of packaging flexible flat goods such as bags, garbage sacks, or the like, wherein a stack is formed from the goods to be packaged and introduced laterally into an opened half tube of film and, whilst partially pressing the included air, welded therein by a separating weld seam which closes the open film edges and by a separating weld seam extending perpendicular thereto to form bag packages. The invention also relates to an apparatus for performing this method.

In a known apparatus of this kind, the half tube of film is pulled in a horizontal position on a table to a filling station, at which the goods are pushed by a pusher into the opened half tube of film, and subsequently to a pressing and welding station together with the goods to be packaged. During filling of the goods, the latter must be displaced on the packaging film under its own weight only under the action of the pressure exerted by the pusher, crumpling and displacement of the goods being unavoidable by reason of the resultant friction. Another disadvantage of the known apparatus is that the half tube of film with the inserted packaging goods have to be pushed from the filling station to the welding station under friction with its support. It is inevitable that the lower wall of the film will become crumpled or displaced as a result of friction. Further, there is the danger that the inserted packaging goods slide away or become displaced so that packaging bags which closely envelop the goods can no longer be formed. Filling of the packaging goods into the half tube of film that forms the bag packages without displacement is particularly necessary when the half tube of film is provided with printed markings that characterise the contents of the package and/or advertisements. In the known apparatus there is the danger that the printing on the half tube of film appears on the finished packaging bags in a displaced position and that the edges of the film are displaced from one another because the film halves were eccentrically brought together during welding. With staggered film edges there is the additional danger of forming faulty seams.

The known apparatus is particularly unsuitable for packaging stacks of plastics bags or sacks because these have an extremely low resistance to bending and cannot be pushed along a support by a pusher that engages one side without considerable deformation.

The object of the invention is to provide a method as well as an apparatus for automatically producing compact bag packages for flexible flat articles without the disadvantages of the known apparatus.

According to the invention, this object is fulfilled in a method of the aforementioned kind in that the half tube of film is brought into a vetical position with its open edges facing upwardly, is pulled under the horizontal stack of goods to be packaged and is there held at its upper edges, that the stack is pushed from above into the vertically suspended half tube of film under pressure exerted from above onto its transverse centre line whilst folding the stack about this centre line, the film being supported at its lower edge, that the bag package is advanced by at least one width of bag package during pressing out of the air and closure by the separating weld seams, and that the following web of film is advanced by the same length. By means of the method according to the invention it is possible to introduce the stack to be packaged without substantial friction into the half tube of film that later forms the envelope whilst folding about a transverse centre line, so that displacement, creasing or crumpling of the goods to be packaged and of the enveloping film are avoided. By reason of the fact that the packaging bag is advanced whilst pressing out the air as well as during welding, i.e. in a compressed condition, displacement of the goods to be packaged relatively to the enveloping film is impossible, so that packaging bags can be produced with a constant height and with suitable printing. At the same time as advancing of the packaging bags, a length of half tube of film necessary for producing the enveloping bag is also advanced so that a piece of film of the same dimensions will always arrive for processing.

The half tubular film of web adjoining the bag package is preferably advanced by a tool applying perforations downstream of the leading transverse weld seam formed by the preceding separating weld. This nature of advancing relieves the leading weld seam from tensile forces and at the same time the perforations for venting the packaging bag are formed whilst it is being compressed.

The half tube of film can be provided with a line of perforations before it is fabricated to an envelope for the bags, the perforations penetrating both walls of the film and extending adjacent the lower folded edge of the film and parallel thereto. This line of perforations permits the packaging bag to be opened very simply by tearing off its perforated cap.

Tying clips in sheet or stip form can be placed under the stack of bags to be packaged. After forming the bag package, these clips lie on the packaged goods so that the clips can be removed first after the bag package has been torn open and, if the packaged goods are bags or sacks, used for tying them shut. The tying clips can, for example, consist of two paper strips which are stuck together and between which a flexible piece of wire of the same length is inserted. With tying clips in sheet form, a plurality of spaced parallel wires is adhered between the two paper webs, a line of perforations penetrating the paper web being located between the wires.

If bags or sacks are packaged in the bag packages in the manner of the invention, these are preferably transversely folded one or two times before stacking so as to produce bag packages of manageable size. The bags to be transversely folded are, in the region of their folding edges, preferably introduced by a sharp air stream in the nip of a pair of squeeze rolls or of a double belt conveyor.

To avoid displacement of the goods to be packaged during stacking, the stack is preferably provided with a longitudinally extending preferably trapezoidal central arch. This arch stabilises the packaging stack.

A tying strip for packaged sacks or bags can be obtained in accordance with another embodiment of the invention in that the bag or sack is, simultaneously with severing from the continuous tubular film in the bag machine, provided with a line of perforations which is parallel to the open bag edge and extends across its width at a small spacing to the open bag side; after filling of the bag or garbage sack, a strip of film is severed along this line of perforation and can be used for tying the filled bag or garbage sack shut.

An apparatus for performing the method of the invention is characterised in accordance with the invention by a stack-forming station with a horizontal depositing table and a depresser mounted thereabove, a folding station with lateral supporting members for the goods to be packaged, a lowerable folding blade therebetween, two laterally disposed resiliently deflective folding edges, conveying means connecting the stack-forming station to the folding station, a filling station which is disposed below the folding station and has preceding means for opening the superposed walls of the half tube of film, means for holding the seaparated upper edges of the film, a pair of plates on both sides of the web of film of a size corresponding to the bag package to be formed, the plates being movable towards and away from each other by pressure cylinders, pressure plates displaceable against spring force towards the confronting sides of the plates, perforating needles mounted on the first plates and directed towards the half tube of web, the needles punching air holes in the half tube of web at the leading edge of the next packaging bag during closure of the plates, an abutment mounted in the lower region of the first pair of plates for catching the inserted stack of bags and an angular separating welding tool connected to the first pair of plates, which tool welds the half tube at its open upper side and behind the inserted stack of bags by means of a transverse separating weld seam, means for moving the plates as well as welding and actuating means connected thereto in the direction of film supply, and a downstream conveyor for discharging the packaged bags over the abutment after opening of the plates.

To ensure that the stack of bags or garbage sacks is sufficiently strong to withstand undesirable deformation on the occurrence of displacing forces, the possibly doubly folded bag or garbage sack may be deposited on a depositing plate which is of trapezium shape in the conveying direction in which the bags or sacks arrive. In this way the bags obtain a greater stiffness in the horizontal direction. Preferably, it is proposed that the outer faces of the depositing plate should lie lower than the central portion.

Film guiding members may be provided below the folding station for an upwardly open half tube.

A pair of resilient spreading plates for the half tubular film is preferably provided in the region of the folding station. These can be operatively connected to folding edges or folding rollers so that the spreading plates move apart when the stack of bags is pressed through the folding gap by the folding blade. Preferably resilient abutments are provided in the path of the spreading plate, the upper film edges of the half tube of film being pressed against the abutment by the spreading plates during filling of the packaging stack.

Alignment of the half tube by the guiding members ensures that during insertion of the folded stack of bags only small frictional forces are created between the walls of the half tube and that the packaging goods are inserted centrally so that any legend on the half tube appears at the desired positions and the film edges are not displaced relatively to one another. The small frictional forces that occur are taken up by the mounting of the film walls at their upper edges.

It is also suggested in an embodiment of the invention that depressors are provided above the depositing plate and lowerable by pressure cylinders onto the stack being formed so as to avoid excessive air being included between the bags of the stack to be formed.

Preferably the pressure cylinder is raised and lowered in the production sequence of the bag machine so that the air is pressed out of each bag that arrives.

In a development of the invention it is further suggested that between the stacking station and the folding station there be a pair of conveyor chains operative in parallel. Preferably a plurality of dogs is fixed to the conveyor chains, which take the accumulated stack of bags from the stacking station to the folding station. Further, it is provided that the dogs of the conveyor chains serve as abutments in the stacking station. The conveyor chains are advanced by the pitch of two dogs after a bag number set on a counter has been reached.

Further, it is to be avoided that during folding of the stack of bags or garbage sacks individual bags become partially detached from the folded product and thereby increase the volume of the bag package. This is achieved in that the folding rollers are mounted for resilient deflection. Preferably the forces of springs act on the shafts of the folding rollers which are pressed apart as the folding blade and the stack of bags guided thereby pass through. It is provided in accordance with the invention that the direction of guiding for the open upper half tube is in the direction of the shafts of the folding rollers.

To ensure that the bag package can be easily opened for use, it is proposed that the half tube drawn from the supply reel be perforatable by a perforating tool. Preferably the perforating tool is provided in the vicinity of the central fold of the half tube.

It is also to be prevented that the film walls of the half tube adhere to one another. For this purpose it is suggested that an opening bar be provided between the walls of the film. To keep the film walls in the open condition at the filling station, it is further provided that between the film walls a pair of resilient spreading plates be provided under the folding station. Preferably the spreading plates are connected to the folding rollers so that the spreading plates move apart when the stack of bags passes through the folding gap during folding.

Welding of the bag edges of the packaging bags, severing of the film edges and severing of the bags from the half tube takes place in known manner by means of an angular welding tool. To ensure that the air included in the packaging bag escapes almost entirely, it is suggested that a first pair of plates carrying the angular welding tool is provided adjacent the filling station, the half tube lying between the first pair of plates, the first plates are each held by a pressure cylinder and movable towards one another by the pressure cylinders, and a second plate is provided on the inside of each first plate and resiliently mounted thereon. These second plates act on the bag package from the left and right-hand side so that the included air escapes therefrom during movement towards one another.

To advance the half tube by one bag width, it is provided that the pressure cylinders carrying the pair of plates are interconnected by slides which are movable in the direction of film feed by screws. Preferably the screws are driven by a motor. The slides carrying the first pair of plates or the pressure cylinders are guided by a pair of guide rods.

In order to achieve a constant bag width for the enveloping bag, and to ensure that a printed impression on the half tube will always assume a central position on the finished bag package relatively to the width of the enveloping bag, it is provided that a photocell is mounted adjacent the half tube for scanning a marking printed on the half tube and the motor driving the screw can be turned off when this marking passes the beam of the photocell. For the case of failure of the photocell, a terminal switch is preferably connected in parallel to the photocell.

To achieve that feeding movement of the first and second pair of plates is positively transmitted to the half tube, it is provided that the first pair of plates is equipped with perforating needles directed towards the half tube, the needles penetrating the walls of the film and positively moving the half tube. This prevents most of the forces from the welding tool or from the second resilient pair of plates from being exerted on the half tube that is to be withdrawn from the supply reel whereby the hot welding seams would become stressed. Preferably the perforations are provided in the half tube at the leading edge of the next packaging bag, through which the air can escape during formation of the bags.

In a further embodiment an abutment pin is provided between the first pair of plates and is fixed to one of the plates. It can be adjusted for height and serves as an abutment for the folding blade. It is provided eccentrically to the folding blade or to the inserted folded stack of bags and is set back in the feeding direction of the half tube so that the centre of gravity of the bag package lies on the side facing the belt conveyor. In this way it serves to eject the finished packaging bag on termination of the welding process after the plates have been opened. Its eccentric position causes the finished packaging bag to tilt over the abutment pin forwardly onto a belt conveyor or the like.

An example of the invention is illustrated in the drawing and will now be described in detail. In the drawing FIG. 1 is a diagrammatic assembly view of a bag machine with packaging apparatus;

Figure 1:
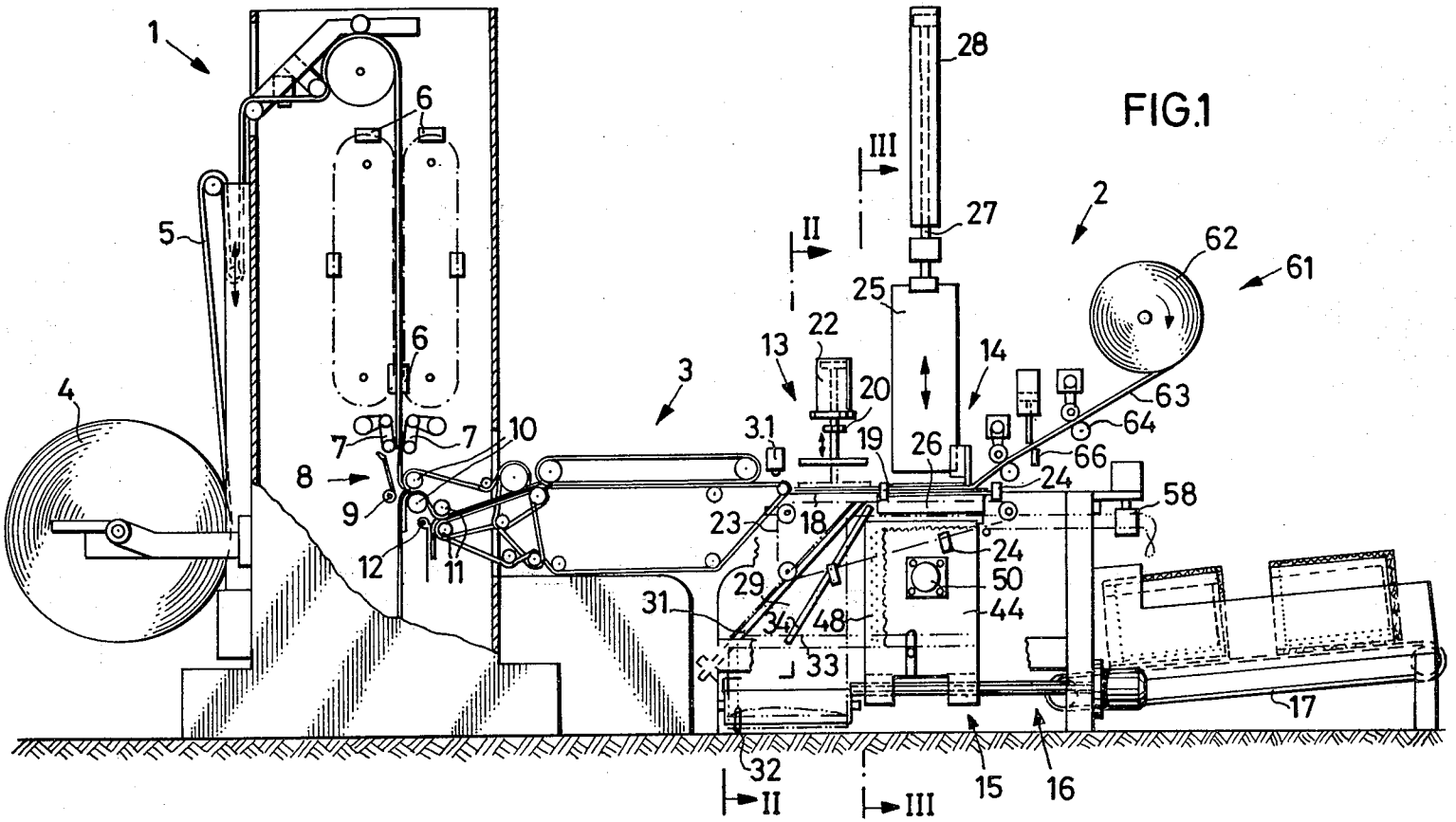

A bag machine 1 and a packaging apparatus 2 are interconnected by a double belt conveyor 3. A plastics tube of film 5 is withdrawn from a supply reel 4 and transversely welded by a pair of welding tongs 6. This forms the base of a bag or garbage sack which, simultaneously with welding the base seam, is severed as a finished bag or garbage sack from the tubular film 5. The severed bag or garbage sack is fed by a belt guide 7 to a first transverse folding station 8 which comprises an air knife 9 and a pair of folding rollers 10. The air knife 9 which is in the form of a jet tube causes the bag or garbage sack in front of the pair of folding rolls 10 to be introduced in the nip of the folding rollers by its central portion and to be folded by the folding rollers 10. A second transverse fold is achieved in a second pair of folding rollers 11 between which the already transversely folded bag or garbage sack is introduced by a second air knife 12.

The doubly folded bag or garbage sack is fed by the belt conveyor 3 to the packaging apparatus 2. This comprises a stacking station 13, a folding station 14, a filling station 15 below the folding station 14, a depositing station 16, and a belt conveyor 17.

Figure 2:
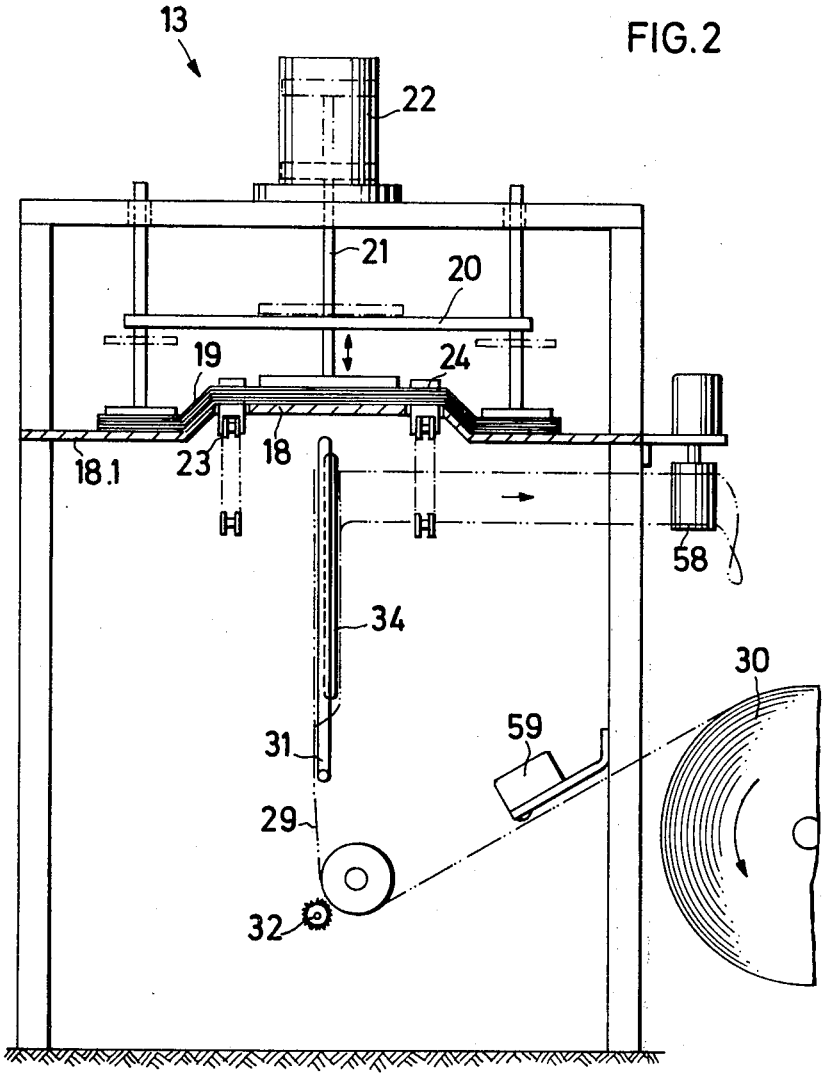
FIG. 2 is a section on the line II-II in FIG. 1.
Figure 3:
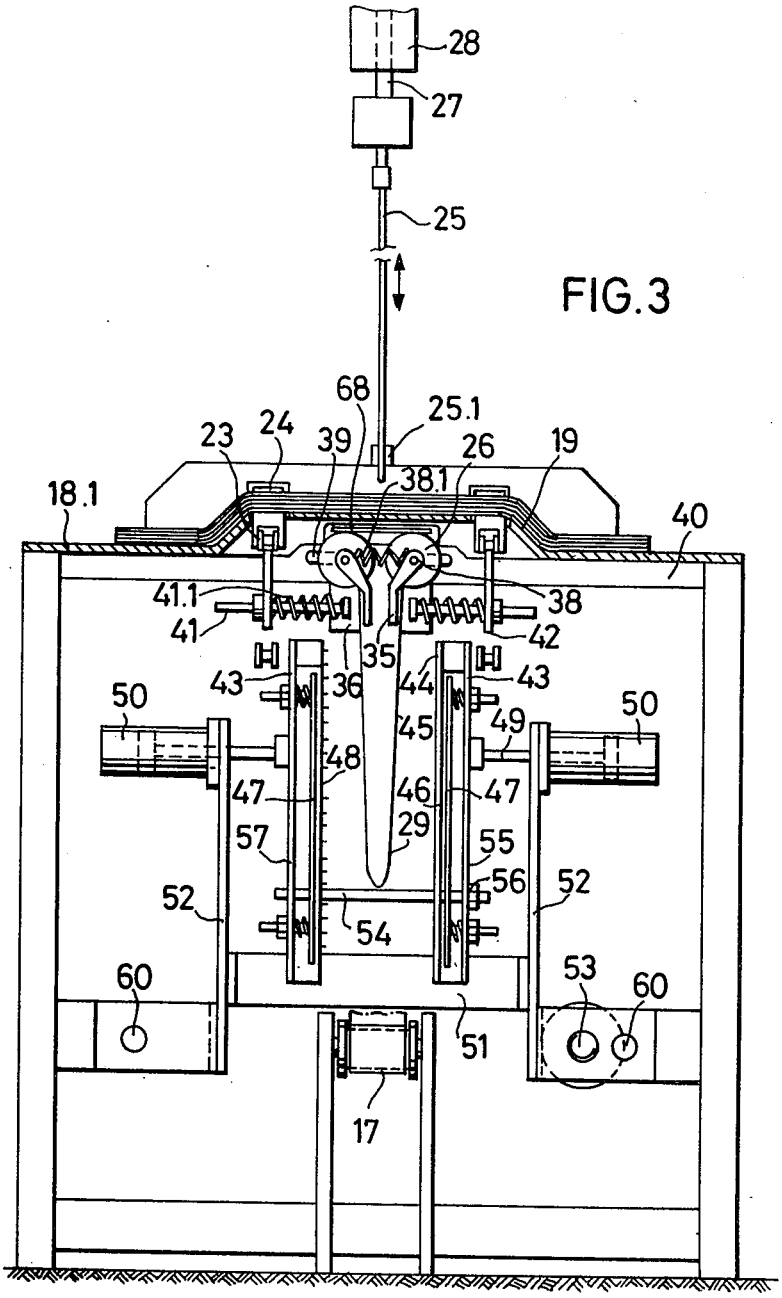
FIG. 3 is a section on the line III-III in FIG. 1.

The bags or garbage sacks supplied by the belt conveyor 3 are, as shown by FIG. 2, deposited at the stacking station 13 on a trapezoidal depositing plate 18 of which the outer faces 18.1 lie lower than the central portion. In this way a stack 19 of superposed bags or garbage sacks is given a trapezoidal cross-section as viewed in the feeding direction, such cross-section facilitating further transport to the folding station 14 and preventing the stack 19 of bags from crumpling and thereby reaching the folding station 14 in an untidy condition. Above the depositing plate 18 there are depressors 20 which, after arrival of each bag or garbage sack, are lowered onto the depositing plate 18 or the stack of bags already formed thereon and express the air contained in the bag folds or between the bags. For this purpose the depressors 20 are connected to a piston rod 21 of a pressure cylinder 22 fixed to the frame of the packaging apparatus 2, the pressure cylinder being controlled in sequence with the arriving bags or garbage sacks. The control can, for example, be effected by a photocell 3.1 combined with a bag counter. Beneath the depositing plate 18 there are two conveyor chains 23 which move parallel to one another and to which a number of dogs 24 is secured. The dogs 24 are in each case uniformly distributed along the conveyor chains 23 and project therebeyond through slots in the depositing plate 18. The dogs of one chain run in synchronism with the dogs of the other chain. The conveyor chains 23 are controlled by their drive (not shown) in such a way that two dogs 24.1 of the two conveyor chains 23 stop at the depositing plate 18 such that the bags or garbage sacks supplied by the belt conveyor 13 abut the dog 24.1 at the desired position and there form the stack 19. After reaching a bag number as set on the counter that is operatively connected to the photocell 3.1, the conveyor chains 23 are advanced by the pitch of two dogs 24, whereby the stack 19 of bags reaches the folding station 14. The latter comprises a folding blade 25 and two loosely rotatable folding rollers 26, the shafts of the folding rollers 26 lying in the feed direction of the bags or garbage sacks. The folding blade 25 is fixed to a piston rod 27 of a pressure cylinder 28 which is secured to the frame of the packaging apparatus 2 and, at the plates that come into contact with the stack, is provided with a coating of polytetrafluoroethylene or a similar low-friction material. This prevents the folding blade 25 from adhering to the inner bag of the stack 19 of bags after the stack has been folded. The folding blade 25 is led in a guide 25.1 and secured against rotation.

A film in the form of a half tube 29 is passed in a vertical position below the stacking station 13 and the folding station 14 in the feeding direction of the bags or garbage sacks to be collected for the purpose of packaging the folded stack. The film is withdrawn from a supply reel 30 of which the shaft is in this example disposed in the feeding direction of the half tube 29. The half tube 29 is fed to a turning bar 31 by guide rolls (not shown), the turning bar turning the half tube 29 into the prescribed position. Behind the turning bar 31 the half tube 29 has its open side pointing upwardly. The station disposed below the folding station 14 has already been designated the filling station 15. Between the supply reel 30 and the turning bar 31 the half tube is provided with lines 33 of perforations to both sides of its folding line by means of a perforating tool 32, the lines of perforations making it easier to tear open the package During use of the bag package. Downstream of the turning bar 31 an opening bar 34 is provided between the two halves of web of the half tube 29 so that adhering films will be positively separated. At the filling station 15 the two halves of half tube are held apart by spreading plates 35 which are fixed to lugs 36. The lugs 36 have holes 37 receiving the shafts 38 of the folding rollers 26. The shafts 38 are guided in slots 39 of guide plates 40 fixed to the frame, the guide plates being provided on both sides adjacent the end faces of the folding rollers 26. On the axes 38 there act tension springs 38.1, which tend to reduce the spacing between the folding rollers 26. During fold of the stack 19 of bags the folding rollers 26 are pressed apart against the force of the springs 38.1 so that the folded product is compressed and will thereby contain very little air and its thickness will correspond substantially to the thickness of the material of the collected bags or garbage sacks. Abutments 41 are provided adjacent the spreading plates 35 and guided in walls 42 fixed to the frame. Springs 41.1 act on the abutments 41. The edges of the half tube 29 lie between the abutments 41 and the spreading plates 35. During folding of the stack 19 of bags, the folding rollers 26 as well as the spreading plates 35 move apart. The spreading plates 35 thereby lie against the abutments 41 and retain between each other the film edges of the half tube 29.

To the right and left adjacent the half tube 29 in the filling station 15 there is provided a welding tool consisting of first plates 43 and welding jaws 44 that are connected to the first plates 43 and are formed as a separating welding tool and has an angular shape. One limb 45 of the angle lies horizontally and effects closure of the packaging bag and severing of the lateral film edges of the half tube 29. The other, 46, which is perpendicular thereto, welds the two film webs of the half tube 29 together and severs the finished packaging bag from the half tube 29. At the same time the leading seam of the next packaging bag is formed on the half tube 29.

Resiliently mounted second plates 47 which, during closure of the welding jaws 44, express air disposed between the half tube 29 and the folded stack 19 of bags are provided between the first plates 43 and the half tube 29. The first plates 43 are held by the piston rods 49 of pressure cylinders 50 which are controlled by a control (not shown) at the predetermined instant and for a period suitable for the welding operation and effect closure of the welding jaws 44. Perforating needles 48 provided on the first plates 43 and directed to the half tube 29 punch air holes in the half tube 29 at the leading edge of the next packaging bag during closure of the welding jaws 44. Air can escape through the holes during formation of the enveloping bag. The pressure cylinders 50 are seated on supports 54 connected to slides 51. The slides 51 are longitudinally displaceable in a direction parallel to the folding rollers and are guided on guide bars 60. In the example, the longitudinal displacement is effected by a screw 53 driven by a motor. By means of the screw 53 the welding tool is displaced during the welding operation. The half tube 29 is thereby paid out from the supply reel by the displacement path. The perforating needles 48 thereby transmit to the half tube 29 the force necessary for unwinding the half tube 29 and therefore relieve the weld seams that have just been formed. By altering the displacement path, the width of the packaging bag can be varied within limits. The length of the displacement path is controlled by a photocell 59 which scans a marking printed on the edge of the film. For safety reasons a terminal switch (not shown) is connected in parallel to the photocell 59 and so adjusted that the path to be controlled by the photocell 59 is exceeded only by a small amount.

An abutment pin 54 is provided between the first plates 43. One end of the pin 54 is offset and has a screwthread which is displaceable for height in a slot 55 of one of the plates 43 and securable in the selected position by a nut 56. The other end of the abutment pin 54 passes through a slot 57 of the other plate 43. The abutment pin 54 has two functions. Firstly, it serves to limit the path of the folding blade 25 because the pressure cylinder 28 is so dimensioned for length and so mounted that its piston will not reach the lower end wall of the pressure cylinder 28 during folding. The abutment pin 54 is preferably adjusted for height so that the nose of the half tube 29 rests loosely thereon. During insertion the folded stack 19 of bags or garbage sacks strikes the abutment pin 54. This ensures that the stack 19 is inserted up to the nose and yet the half tube is not overstressed. The other function of the abutment pin 54 concerns ejection of the packaged stack 19 from the depositing station 16. For this purpose the abutment pin 54 is not provided centrally of the bag package but somewhat set back in the displacement direction of the half tube 29 so that the centre of gravity of the bag package lies on the side adjacent the belt conveyor 17. After the bag package has been displaced to the depositing station 16 during welding of the separating weld seams and after the welding tool has been opened, the package of bags swings over the abutment pin 54 out of the welding tool and falls onto the belt conveyor 17 which takes the bag package further to a depositing bin (not shown).

Above the belt conveyor 17 there is a pair 58 of tension rolls which is for example driven by a rotary field magnet and engages the severed film edges of the half tube 29 and leads them to a waste bin (not shown). By means of the rotary field magnet the half tube 29 is held centrally of the film edges in its upright position and under a suitable tension. A bar 67 is provided on one of the first plates 43; it engages under the film edges of the half tube 29 and supports it against sagging.

Adjacent the folding station 14 there is a supply device 61 for supplying tying clips to the folding station 14. The tying clips are wound up on a reel as an endless web. The web contains so many tying clips in its width as there are bags or garbage sacks in the package. The tying clips in this example consist of two paper strips adhered to one another and between which an easily bendable wire is inserted. The tying clips can be easily separated from one another by a perforated seam.

Figure 4:
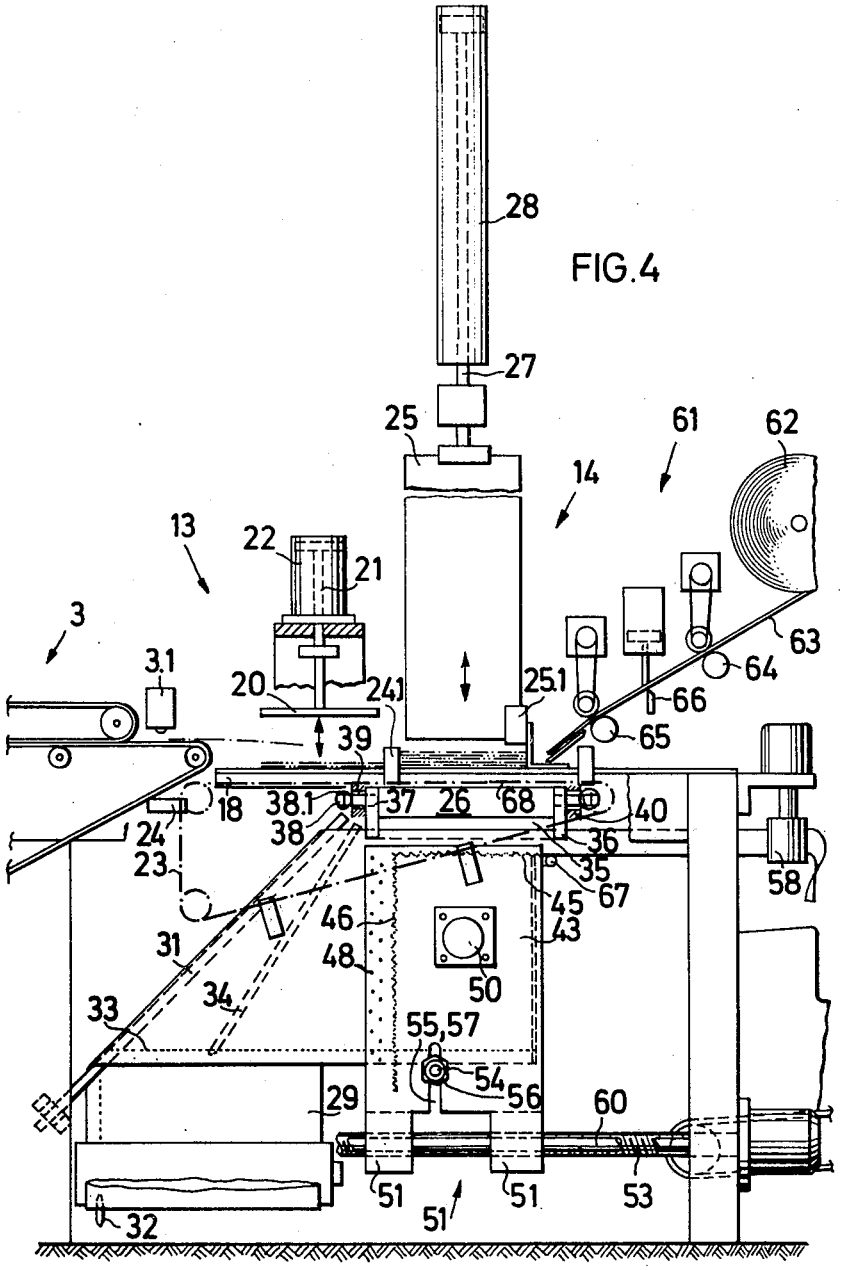
FIG. 4 is an enlarged view of the packaging apparatus.

FIG. 4 shows a supply reel at 62, on which a web of tying clips is wound, and the web withdrawn from the supply reel at 63. The web 63 is withdrawn by a pair of feed rolls 64. A cutting tool 66 severs suitable lengths from the web 63. The resultant sheet 68 of tying clips is fed to the folding station 14 by feed rolls 65. The feed rolls 64, 65 and the cutting tool 60 are controlled in sequence with the folding station 14 by a switching device (not shown). After delivery, the sheet 68 of tying clips comes to lie on the folding rollers 26 and, after transmission of the stack 19 of bags and garbage sacks, is folded away together with same in the opened half tube 29 held ready below the folding station 14.

Pushing the folded stack 19 of bags in the half tube 29 from above avoids every danger of crumpling of a wall of film or both walls of the half tube 29 of film under friction, and thus no interference can be caused thereby. Feeding of the half tube 29 from the filling station 15 to the depositing station 16 cannot cause damage of the half tube 29 under friction because the stack 29 of bags is moved with the welding tool closed and, simultaneously therewith, the half tube 29 follows this movement in a condition in which it is not loaded by the weight of the goods to be packaged.

We claim:

1. In a method for packaging flexible flat goods such as bags, garbage sacks, or the like, wherein a horizontal stack is formed from the goods to be packaged and introduced laterally into an opened half tube of film and, whilst partially pressing the included air, welded therein by a separating weld seam which closes the open film edges and by a separating transverse weld seam extending perpendicular thereto to form bag packages, the improvement comprising the steps of: orienting the half tube of film into a vertical position with its open edges facing upwardly, moving the horizontal stack of goods to be packaged over the half tube, holding the half tube at its upper edges, pushing the stack from above into the vertically suspended half tube of film by exerting pressure from above the stack of goods onto its transverse centre line, folding the stack about the center line, while it is being pushed into the half tube of film, supporting the film at its lower edge, advancing the half tube of film by at least one width of a bag package to remove the portion of the film containing the stack and to position the following portion of film in readiness to receive a stack of goods, pressing out the air from between the stack that has been pushed into the half tube of film and the half tube of film, and closing the half tube of film by separating weld seams to complete the bag package while it is advancing.

2. In a method according to claim 1, further including the step of applying perforations downstream of a transverse weld seam.

3. In a method according to claim 2, further including the steps of providing the half tube of film with a line of perforations before it is fabricated into an envelope for the bags, the perforations penetrating both walls of the film and extending adjacent the lower folded edge of the film and parallel thereto.

4. In a method according to claim 3, further including the step of placing tying clips in sheet or strip form under the stack of bags to be packaged.

5. In a method according to claim 4, further including the steps of transversely folding the bags to be packaged at least once and stacking the folded bags.

6. In a method according to claim 5, further including the steps of introducing the at least once folded bags, in the region of their folding edges, into the nip of a take-off means by a stream of air.

7. In a method according to claim 6, further including the step of providing the goods to be packaged with a longitudinally extending central arch during stacking.

8. In a method according to claim 7, further including the step of providing the bags to be packaged with a line of perforations which is parallel to the open bag sides and defines a strip of film.

9. Apparatus for packaging flexible flat goods, comprising: a stack-forming station with a horizontal depositing plate and a depressor mounted thereabove, a folding station with latoral supporting members for the goods to be packaged, a lowerable folding blade therebetween two laterally disposed resiliently deflective folding rollers, conveying means connecting the stack-forming station to the folding station, a filling station which is disposed below the folding station and has preceding opening means for opening the superposed walls of a half tube of film, holding means for holding the separated upper edges of the film, a first pair of plates on both sides of the web of film of a size corresponding to the bag package to be formed, the first pair of plates being movable towards and away from each other pressure cylinders for moving said first pair of plates, pressure plates displaceable against spring force towards the confronting sides of the plates, spring means connected to the pressure plates, perforating needles mounted on the plates and directed towards the half tube of film, the needles punching air holes in the half tube of film at the leading edge of the next packaging bag during closure of the first plates, an abutment mounted in the lower region of the first pair of plates for catching an inserted stack of bags and an angular separating welding tool connected to the first pair of plates, which tool welds the half tube of film at its open upper side and behind the inserted stack of bags by means of a transverse separating weld seam, an actuating means, moving means for moving the first pair of plates and a second pair of plates as well as the welding and actuating means connected thereto in the direction of film supply, and a downstream conveyor for discharging the packaged bags over the abutment after opening of the plates.

10. Apparatus according to claim 9, characterised in that the horizontal depositing plate at the stack-forming station has a central elevated portion and lower lateral portions, and that the depressor comprises correspondingly stepped depressor plates.

11. Apparatus according to claim 10, characterised in that the central elevated portion is trapozoidal in cross-section.

12. Apparatus according to claim 9, wherein the stack of goods is introduced into a folding gap formed by two resiliently deflectable folding rollers.

13. Apparatus according to claim 12, further including movably mounted shafts of the folding rollers and springs located therebetween.

14. Apparatus according to claim 9, further including photocells scanning printed markers printed on the half tube of film for controlling the conveying path of the plate.

15. Apparatus according to claim 14, further including terminal switches for separating the conveying path of the plates.

16. Apparatus according to claim 9, further including a supply reel of the half tube of film and a turning bar for transferring the web of half tubular film into a vertical position and a frame for horizontally mounting the supply reel.

17. Apparatus according to claim 9, further including a pair of parallel conveyor chains located between the stack-forming station and the folding station.

18. Apparatus according to claim 17, further including a plurality of dogs fixed to the conveyor chains to form abutments for the stack being formed in the stack-forming station.

19. Apparatus according to claim 9 further including a wheel for applying a line of perforations to the half tubular film of web parallel to folded edge thereof.

20. Apparatus according to claim 9, further including a pair of resilient spreading plates for the half tubular film, the plates being located in the region of the folding station.

21. Apparatus according to claim 20, wherein the spreading plates are operatively connected to the folding rollers so that the spreading plates move apart when the stack of bags is pressed through the folding gap by the folding blade.

22. Apparatus according to claim 21, further including a resilient abutment located in the path of the holding means, the upper film edges of the half tube of film being pressed against the abutment by the holding means during filling of the packaging stack.

23. Apparatus according to claim 9, further including, supports for mounting the pressure cylinder, slides for interconnecting the supports and which are movable in the direction of film feed, and screws for moving the slides.

24. Apparatus according to claim 23, wherein the screws are drivable by a motor.

25. Apparatus according to claim 9, wherein the abutment comprises a pin which is connected to one of the first pair of plates and which is set back eccentrically to the packaging stack and relatively to the direction of feeding the packaging stack.

26. Apparatus according to claim 25, wherein the abutment pin is adjustable for height.

27. Apparatus according to claim 9, further including a pair of feed rolls located behind the folding station, the feed rolls guiding an upper marginal strip of the half tube of film that is severed by the separating welding tool.

28. Apparatus according to claim 9, wherein one of the first plates forms a horizontal bar and connects with one of the first plates for supporting the front film edge of the half tube of film.

29. In an apparatus of packaging flexible flat goods such as bags, garbage sacks, or the like, wherein means are provided to form from the goods to be packaged and to introduce the stack laterally into an opened half tube of film, means for partially pressing the included air, means for welding the film by a separating weld seam which closes the open film edges and by a separating transverse weld seam extending perpendicular thereto to form bag packages, the improvement comprising the steps of:

means for orienting the half tube of film into a vertical position with its open edges facing upwardly, means for moving the horizontal stack of goods to be packaged over the half tube, means for holding the half tube at its upper edges, means for pushing the stack from above into the vertically suspended half tube of film by exerting pressure from above the stack of goods onto its transverse center line and to fold the stack about the center line while it is being pushed into the half tube of film, means for supporting the film at its lower edge, means for advancing the half tube of film by at least one width of a bag package while pressing out the air from between the stack and the half tube of film to remove the portion of film containing the stack from underneath the means for pushing the stack from above and to position thereunder a following portion of film in readiness to receive a stack of goods, and means for closing the half tube of film by separating weld seams to complete the bag package while it is advancing.

* * * * *